US008740304B2

(12) United States Patent
Yu

(10) Patent No.: US 8,740,304 B2
(45) Date of Patent: Jun. 3, 2014

(54) ASSISTANT STANDING SEAT

(75) Inventor: Li-Wei Yu, New Taipei (TW)

(73) Assignee: Broadmaster Biotech Corp., New Taipei (TW)

( * ) Notice: Subject to any disclaimer, the term of this patent is extended or adjusted under 35 U.S.C. 154(b) by 348 days.

(21) Appl. No.: 13/273,892

(22) Filed: Oct. 14, 2011

(65) Prior Publication Data

US 2013/0093230 A1 Apr. 18, 2013

(51) Int. Cl.
*A61G 5/14* (2006.01)

(52) U.S. Cl.
USPC ..... 297/330; 297/DIG. 10

(58) Field of Classification Search
USPC ..... 297/DIG. 10, 313, 330
See application file for complete search history.

(56) References Cited

U.S. PATENT DOCUMENTS

| | | | | |
|---|---|---|---|---|
| 3,250,569 | A * | 5/1966 | Gaffney | 297/330 |
| 4,838,612 | A * | 6/1989 | Cross | 297/338 |
| 5,116,100 | A | 5/1992 | Iversen | |
| 5,316,370 | A | 5/1994 | Newman | |
| 5,333,931 | A * | 8/1994 | Weddendorf | 297/334 |
| 6,637,818 | B2 * | 10/2003 | Williams | 297/330 |
| 2003/0090135 | A1 | 5/2003 | Newman et al. | |
| 2011/0084529 | A1 * | 4/2011 | Huang | 297/330 |

* cited by examiner

*Primary Examiner* — Milton Nelson, Jr.
(74) *Attorney, Agent, or Firm* — Muncy, Geissler, Olds & Lowe, P.C.

(57) ABSTRACT

The invention discloses an assistant standing seat comprising a base having a positioning nest and a locating recess, a driving module installed in the positioning nest of the base, a shearing device mounted in the locating recess of the base and a seat mounted on the shearing device, wherein the shearing device has a top plate, a bottom plate pivotally mounted to a front part of the top plate, a U-shape bracket pivotally mounted to a middle part of the bottom plate and a translational device moving between the U-shape bracket and the bottom plate. With the above seat, a user's weight can be distributed to the top plate and the U-shape bracket to decrease a resistance force of the translational device when the translational device moves, and further avoid a difficult elevation of the assistant standing seat.

13 Claims, 17 Drawing Sheets

ASSISTANT STANDING SEAT

BACKGROUND OF THE INVENTION

1. Field of the Invention

The present invention relates to an assistant standing seat, and more particularly to the assistant standing seat capable of assisting a user to change from a sitting posture to a standing posture easily, so as to reduce the burden exerted onto the user's knee and the force expended.

2. Brief Description of the Related Art

A knee joint is one of the most frequently moving parts of a human body, and many movements, such as walking, running, jumping, squatting, and kneeling, require the assistance and coordination of the knee joint to complete a smooth movement. However, our body and organs will become deteriorated due to aging, and there is no exception to the knee joint. Many people are suffered for knee joint problem caused by injury or a long-time use of the knee joint, such that they feel pain of knee joint during a movement, and the knee joint may not be bent or moved easily. Therefore, the knee joint pain is a troublesome problem to many people, regardless of they are male, female, young or old.

In the movements of our daily life, the knee joint is one of the very important joints. For example, switching sitting posture and a standing posture requires the use of the knee joint, and thus patients with a knee joint problem will feel painful and uncomfortable when they change postures between a sitting position and a standing position. Therefore, related manufacturers produce medical devices or accessories to help patients to reduce the pain and discomfort caused by changing their postures.

A portable occupant-arising assist chair with torsion springs as disclosed in U.S. Pat. No. 5,116,100 is placed on a soft chair such as an easy chair or sofa to help its user in being seated an arising, includes a rigid U-shaped lower frame that is spanned by a sheet of pliable material that is in contact with the seat, and further includes an upper U-shaped frame formed of tubing that is spanned by a rigid panel. The upper frame is resiliently and pivotally mounted to the lower frame by means of left and right torsion springs, which apply an upward force to the rigid panel to facilitate the user to sit down or arise.

A portable seating assist device as disclosed in U.S. Pat. No. 5,316,370 can be used in different chairs and furniture to facilitate users to change from a sitting posture to a standing posture, wherein the portable seating assist device comprises a base portion placed on the horizontal surface of a chair, a seating surface hingedly mounted to the base, and a compression spring mounted between the seating surface and the base to urge the two apart and allow an upwardly assisted motion between a closed and open position, so as to allow a user to stand up gradually from a sitting posture and reduce the burden exerted onto the knee joint.

However, the portable occupant-arising assist chair and the portable seating assist device are not suitable for an overweight user. Since this device just uses a compression spring or a torsion spring as a lifting force source to provide a rising force for the elevation, and the rising force varies (or becomes weaker) with the condition of spreading open the portable seating assist device. Therefore, the compression spring is usually insufficient to support overweight users.

As disclosed in Pat. Application No. US 2003/090135 (A1), the electric seat assist device comprises: a base, a seat pivotally secured to a forward portion of the base, a scissors mechanism for use in moving the seat relative to the base, and the scissors mechanism including at least one upper cam surface extending from the bottom of the seat, a lower cam surface extending upwardly from the base, an electric control module using an electric motor as a force source, and being positioned between the upper and lower cam surfaces, and drive means for moving the seat with respect to the base to facilitate a user to change postures between a sitting posture and a standing posture.

The electric seat assist device uses the electric motor as the force source to overcome the drawback of the compression spring used in the portable seating assist device, and allow a user to apply a certain force in the process of changing postures from the sitting posture to the standing posture to assist the user to stand up. However, the scissors mechanism of the electric seat assist device has to fully support the weight of the user. Therefore, the weight of the user directly increases the resistance of the scissors mechanism that can move between the base and the seat. As a result, the electric seat assist device cannot be elevated easily.

Regardless of the portable seating assist device as disclosed in U.S. Pat. No. 5,316,370 or the electric seat assist device as disclosed in the U.S. Pat. Application No. US 2003/090135 (A1), the assist devices are insufficient for overweight users. Obviously, the structures of the conventional seats still require improvements.

SUMMARY OF THE INVENTION

Therefore, it is a primary objective of the present invention to provide an assistant standing seat, comprising:

a base, having a positioning nest and a locating recess interconnected with the positioning nest;

a driving module, installed in the positioning nest of the base, and having an electric motor for providing a kinetic force source;

a shearing device, installed in the locating recess of the base, and having a top plate, a bottom plate pivotally installed at the front of the top plate, an U-shape bracket pivotally coupled to the middle of the bottom plate, and a translational device capable of moving between the bottom plate and the U-shape bracket; and a seat, installed on the top plate of the shearing device of the base.

To achieve the foregoing objective, the present invention provides an assistant standing seat using the top plate of the shearing device and the U-shape bracket to support the user's upper half of the body to reduce the resistance produced when the translational device is shifted horizontally forward from the rear of the bottom plate to avoid the difficulty of elevating the assistant standing seat.

When a user sits on the assistant standing seat, the user's buttock will be situated at the rear of the seat, and both thighs will be placed at the front end of the seat. If the user wants to stand up, the translational device of the shearing device will shift horizontally forward from the rear of the bottom plate, such that the translational device abuts the U-shape bracket to pivotally turn the U-shape bracket of the shearing device upward. When the U-shape bracket is pivotally turned upward, the top plate of the shearing device will also pivotally turn upward with the U-shape bracket, so as to elevate and tilt the seat. Then, the center of gravity of the user will be lifted upward together with the seat and biased in a direction towards the user's knee to reduce the burden exerted onto the user's knee and waist to facilitate the user to change a posture.

BRIEF DESCRIPTION OF THE INVENTION

DETAILED DESCRIPTION OF THE PREFERRED EMBODIMENTS

With reference to FIGS. 1 to 5 for an assistant standing seat (10) of the present invention, the assistant standing seat (10) comprises a base (1000), a driving module (2000), a shearing device (3000), a protective cover (4000), a seat (5000), a connecting stand (6000), a cushion (7000) and a control device (8000).

The base (1000) has two side boards (1100), two pivot slots (1200), a positioning nest (1300) and a locating recess (1400), and the two pivot slots (1200) are formed on the two side boards (1100) respectively and corresponding to one another and the locating recess (1400) is interconnected with the positioning nest (1300).

Figure 6:
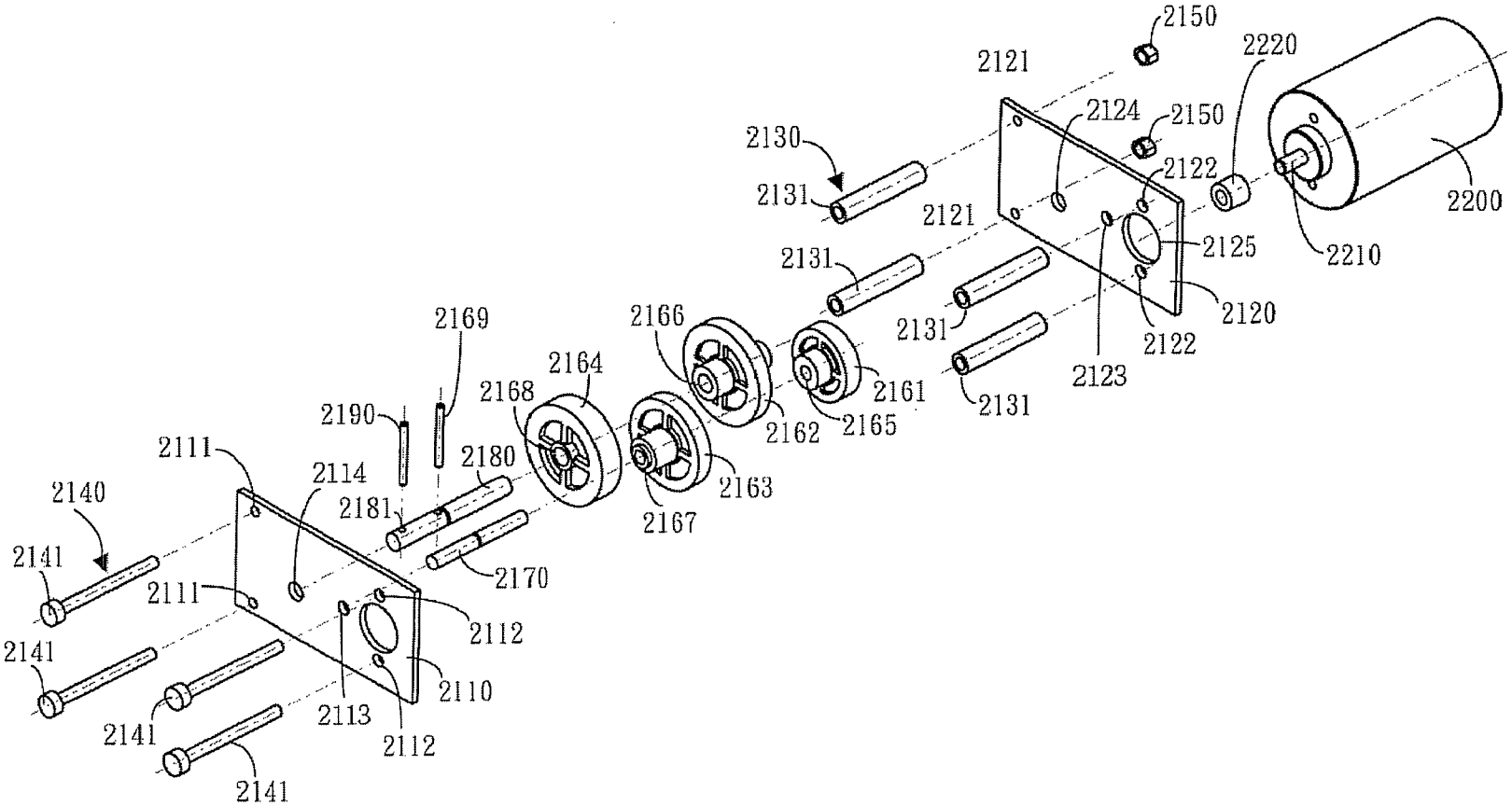
FIG. 6 is an exploded view of a driving module in accordance with a preferred embodiment of the present invention.

In FIG. 6, the driving module (2000) is installed in the positioning nest (1300) of the base (1000), and includes a gear module (2100) and an electric motor (2200) for providing a force source. The gear module (2100) includes a first partition (2110), a second partition (2120), two socket sets (2130), two bolt sets (2140), two nuts (2150), a shifting gear set (2160), a transmission shaft (2170), an output shaft (2180) and a first positioning rod (2190).

The first partition (2110) includes two first bolt holes (2111), two third bolt holes (2112), a first fixing hole (2113) and a third fixing hole (2114). The first fixing hole (2113) is formed on the first partition (2110) and proximate to a middle position of the first partition (2110). The third fixing hole (2114) is formed on the first partition (2110) and proximate to the first fixing hole (2113) of the first partition (2110).

The second partition (2120) includes two second bolt holes (2121), two fourth bolt holes (2122), a second fixing hole (2123), a fourth fixing hole (2124) and a through hole (2125). The two second bolt holes (2121) are formed on the second partition (2120) and corresponsive to the two first bolt holes (2111) of the first partition (2110) respectively. The two fourth bolt holes (2122) are formed on the second partition (2120) and corresponsive to the two third bolt holes (2112) of the first partition (2110) respectively. The second fixing hole (2123) is formed on the second partition (2120) and corresponsive to the first fixing hole (2113) of the first partition (2110). The fourth fixing hole (2124) is formed on the second partition (2120) and corresponsive to the third fixing hole (2114) of the first partition (2110), and the through hole (2125) is formed on the second partition (2120) and proximate to the third fixing hole (2114) of the second partition (2120) and the two fourth bolt holes (2122).

Each socket set (2130) includes two sockets (2131) and each bolt set (2140) includes two bolts (2141). The two bolts (2141) of one of the bolt set (2140) are passed into the first bolt hole (2111) of the first partition (2110), the two sockets (2131) of the socket set (2130), the two nuts (2150) and the second bolt hole (2121) of the second partition (2120) respectively, and the two bolts (2141) of the other bolt set (2140) are passed into the third bolt hole (2112) of the first partition (2110), the two sockets (2131) of another socket set (2130) and the electric motor (2200) to constitute a space for containing the shifting gear set (2160).

The shifting gear set (2160) includes a first transmission gear (2161), a second transmission gear (2162), a third transmission gear (2163), and a fourth transmission gear (2164), and the first transmission gear (2161), the second transmission gear (2162), the third transmission gear (2163) and the fourth transmission gear (2164) have a first shaft hole (2165), a second shaft hole (2166), a third shaft hole (2167) and a fourth shaft hole (2168) respectively for installing the gear module (2100) between the first partition (2110) and the second partition (2120).

The transmission shaft (2170) is passed into the first shaft hole (2165) of the first transmission gear (2161) and the third shaft hole (2167) of the third transmission gear (2163) and pivotally installed between the first fixing hole (2113) of the first partition (2110) and the second fixing hole (2123) of the second partition (2120).

The output shaft (2180) is passed into the second shaft hole (2166) of the second transmission gear (2162) and the fourth shaft hole (2168) of the fourth transmission gear (2164) and pivotally installed between the third fixing hole (2114) of the first partition (2110) and the fourth fixing hole (2124) of the second partition (2120), and the fourth transmission gear (2164) is secured onto the output shaft (2180) by a bolt rod (2169) for transmitting force effectively. In addition, a first positioning hole (2181) is formed radially at an end of the output shaft (2180).

The first positioning rod (2190) is inserted into the first positioning hole (2181) of the output shaft (2180) of the gear module (2100) for providing a rotation direction of the output shaft (2180).

The electric motor (2200) is mounted in the locating recess (1400) of the base (1000) and includes a motor shaft (2210) and a driving gear (2220), and the motor shaft is passed into the through hole (2125) of the second partition (2120) for providing a force source for the driving module (2000), and the driving gear (2220) is mounted on the motor shaft (2210) of the electric motor (2200) and engaged with the first transmission gear (2161) of the gear module (2100), so that the force of the electric motor (2200) can be transmitted from the electric motor (2200) to the gear module (2100).

Figure 7:
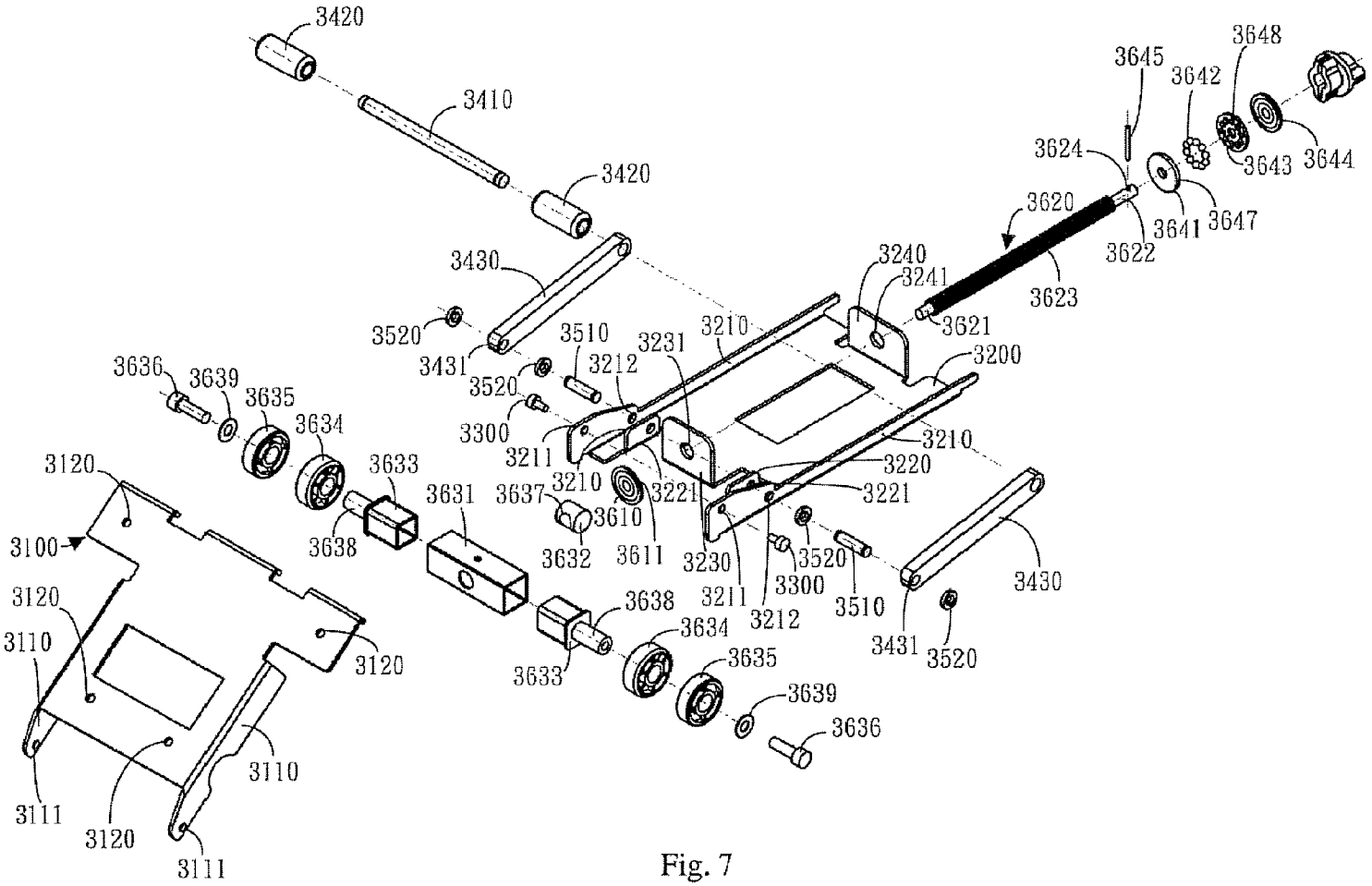
FIG. 7 is an exploded view of a preferred embodiment of the present invention.

In FIG. 7, the shearing device (3000) is installed in the locating recess (1400) of the base (1000) and includes a top plate (3100), a bottom plate (3200), two first shafts (3300), a U-shape bracket (3400), two shaft modules (3500) and a translational device (3600).

The top plate (3100) includes two upper side boards (3110) and four connecting holes (3120). The upper side boards (3110) are formed on both sides of the top plate (3100) respectively and perpendicular to the top plate (3100), and each upper side board (3110) includes a first pivot hole (3111), and the first pivot hole (3111) is formed at a front part of the upper side board (3110), and each connecting hole (3120) is formed on the top plate (3100) and used for a fixing purpose.

The bottom plate (3200) is pivotally mounted at a front part of the top plate (3100) and includes two first lower side boards (3210), two second lower side boards (3220), a front side board (3230) and a rear side board (3240).

The first lower side boards (3210) are formed on both sides of the bottom plate (3200) respectively and perpendicular to the bottom plate (3200), and each first lower side board (3210) has a second pivot hole (3211) and a third pivot hole (3212), and the second pivot hole (3211) is formed at a front part of the first lower side board (3210) and matched with the first pivot hole (3111) of the upper side board (3110) of the top plate (3100), and the third pivot hole (3212) is formed at a middle part of the first lower side board (3210).

The second lower side boards (3220) are formed separately on the bottom plate (3200) and corresponsive to each of the first lower side boards (3210), and each second lower side board (3220) has a fourth pivot hole (3221) formed on the second lower side board (3220) and matched with the third pivot hole (3212) of the first lower side board (3210).

The front side board (3230) is formed at a front end of the bottom plate (3200) and perpendicular to the bottom plate (3200) and includes a first penetrating hole (3231).

The rear side board (3240) is formed at a rear end of the bottom plate (3200) and perpendicular to the bottom plate (3200) and includes a second penetrating hole (3241) corresponding to the first penetrating hole (3231) of the front side board (3230).

Two first shafts (3300) are passed and installed respectively into the first pivot hole (3111) of the two upper side boards (3110) of the top plate (3100) and the second pivot hole (3211) of the first lower side board (3210) of the bottom plate (3200), so that the top plate (3100) and the bottom plate (3200) are pivotally coupled to each other.

The U-shape bracket (3400) is pivotally mounted at a middle part of the bottom plate (3200) and includes a support rod (3410), two rotating sleeves (3420) and two support arms (3430).

The rotating sleeves (3420) are respectively and pivotally installed on both sides of the support rod (3410) for reducing a friction produced between the support rod (3410) and a bottom surface of the top plate (3100).

The support arms (3430) are respectively and pivotally secured to both ends of the support rod (3410), and each support arm (3430) includes a pivotal connecting hole (3431) formed on a side of the support arm (3430) and corresponsive to the third pivot hole (3212) of the first lower side board (3210) of the bottom plate (3200) and the fourth pivot hole (3221) of the second lower side board (3220).

The shaft modules (3500) are respectively and pivotally secured between the U-shape bracket (3400) and the bottom plate (3200), and each shaft module (3500) has a second shaft (3510) and two position limit rings (3520).

Each second shaft (3510) is passed and installed between the third pivot hole (3212) of the first lower side board (3210) of the bottom plate (3200) and the fourth pivot hole (3221) of the second lower side board (3220), such that the U-shape bracket (3400) is pivotally secured to the bottom plate (3200).

The two position limit rings (3520) are sheathed and installed between the first lower side board (3210) and the second shaft (3510) and between the second lower side board (3220) and the second shaft (3510) respectively for limiting the way of moving the second shaft (3510).

The translational device (3600) can be moved between the bottom plate (3200) and the U-shape bracket (3400) and includes a positioning bolt (3610), a lead screw rod (3620), a displacement module (3630) and a buffer module (3640).

The positioning bolt (3610) is sheathed and installed into the first penetrating hole (3231) of the front side board (3230) of the bottom plate (3200), and the positioning bolt (3610) includes a position limit shaft ring (3611) formed on a side of the positioning bolt (3610) for limiting the position of the lead screw rod (3620).

The lead screw rod (3620) is passed and installed into the first penetrating hole (3231) of the front side board (3230) of the bottom plate (3200) and the second penetrating hole (3241) of the rear side board (3240), and the lead screw rod (3620) includes a position limit end (3621), a connecting end (3622) and a thread section (3623). The position limit end (3621) is passed and installed into the first penetrating hole (3231) of the front side board (3230) of the bottom plate (3200) and sheathed on the position limit shaft ring (3611) of the positioning bolt (3610), and the connecting end (3622) is passed and installed into the second penetrating hole (3241) of the rear side board (3240) of the bottom plate (3200), and a positioning hole (3624) is radially formed at the connecting end (3622), and the thread section (3623) is formed on a radial surface of the lead screw rod (3620) for moving the displacement module (3630).

The displacement module (3630) is transversally passed and installed to the lead screw rod (3620), and the displacement module (3630) includes a sleeve (3631), a displacement element (3632), two socket shafts (3633), two friction rollers (3634), two support rollers (3635), two shaft bolts (3636) and two circular rings (3639), wherein the sleeve (3631) is hollow and includes a junction.

The displacement element (3632) is sheathed and installed in the sleeve (3631) and includes a screw hole (3637) transversally formed on the sleeve (3631), and the screw hole (3637) has a diameter matched with the diameter of the thread section (3623) of the lead screw rod (3620), such that the sleeve (3631) can be pivotally turned by the lead screw rod (3620) to produce a forward or backward displacement of the sleeve (3631).

The socket shafts (3633) are sheathed and installed on both sides of the sleeve (3631) respectively, and each socket shaft (3633) includes a sleeve bearing (3638).

The friction rollers (3634) are respectively and pivotally installed to the sleeve bearing (3638) of the socket shaft (3633) and proximate to the socket shaft (3633), and each friction roller (3634) has a diameter.

The support roller (3635) is respectively and pivotally installed at the sleeve bearing (3638) of the socket shaft (3633) and proximate to the friction roller (3634), and each support roller (3635) has a diameter smaller than the diameter of the friction roller (3634), such that when the displacement module (3630) moves, the support roller (3635) can abut the support arm (3430) of the U-shape bracket (3400) to achieve a smooth movement of the U-shape bracket (3400).

The shaft bolts (3636) are sheathed and installed respectively at an end of the sleeve bearing (3638) of the socket shaft (3633) to limit the friction roller (3634) and the support roller (3635) on the sleeve bearing (3638).

The circular rings (3639) are respectively and pivotally installed between the support roller (3635) and the shaft bolt (3636), such that the friction roller (3634) and the support roller (3635) can move linearly forward.

The buffer module (3640) is sheathed and installed between the lead screw rod (3620) and the rear side board (3240) of the bottom plate (3200), and the buffer module (3640) includes a positioning board (3641), a plurality of balls (3642), a fixing board (3643), a ball seat (3644), a second positioning rod (3645) and a connecting element (3646).

The positioning board (3641) is passed and installed at the connecting end (3622) of the lead screw rod (3620), and a plurality of ball slots (3647) is formed on a side of the positioning board (3641).

The balls (3642) are corresponsive to the ball slots (3647) of the positioning board (3641) respectively for dispersing a force exerted on the lead screw rod (3620).

The fixing board (3643) is passed and installed at the connecting end (3622) of the lead screw rod (3620) and proximate to the positioning board (3641), and the fixing board (3643) has a plurality of position limit holes (3648) formed thereon, and the position limit holes (3648) are corresponsive to the ball slots (3647) of the positioning board (3641) respectively to limit the movement range of each ball (3642).

The ball seat (3644) is passed and installed at the connecting end (3622) of the lead screw rod (3620) and proximate to the fixing board (3643) for receiving a force transmitted from the lead screw rod (3620).

The second positioning rod (3645) is inserted into the second positioning hole (3624) of the connecting end (3622) of the lead screw rod (3620) to limit the positioning board (3641), the fixing board (3643) and the ball seat (3644) at the connecting end (3622) of the lead screw rod (3620).

The connecting element (3646) is installed between the connecting end (3622) of the lead screw rod (3620) and the motor shaft (2210) of the electric motor (2200) for fixing the first positioning rod (2190) and the second positioning rod (3645), so that force can be transmitted to the lead screw rod (3620), and the rotating direction of the lead screw rod (3620) is limited.

Figure 8:
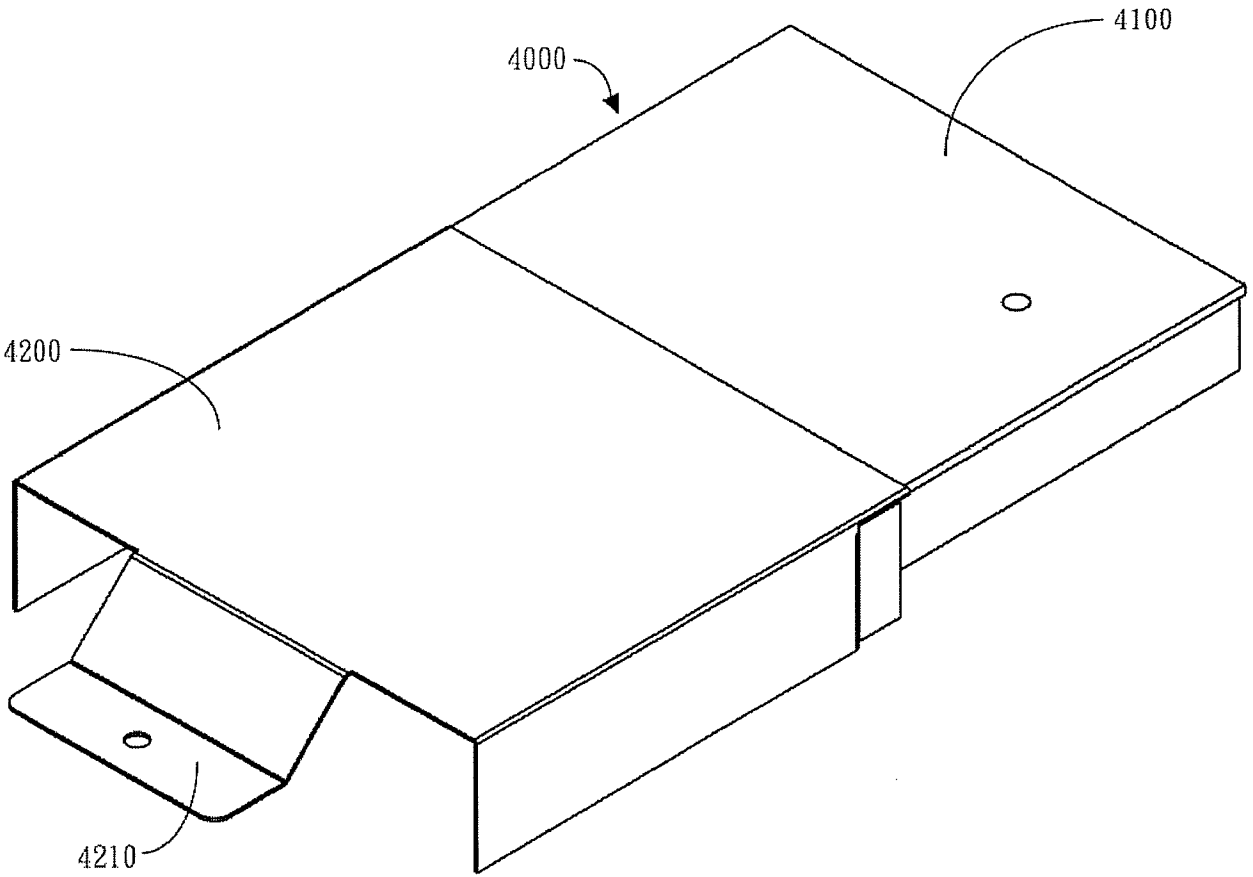
FIG. 8 is a perspective view of a fixing cover in accordance with a preferred embodiment of the present invention.
Figure 9:
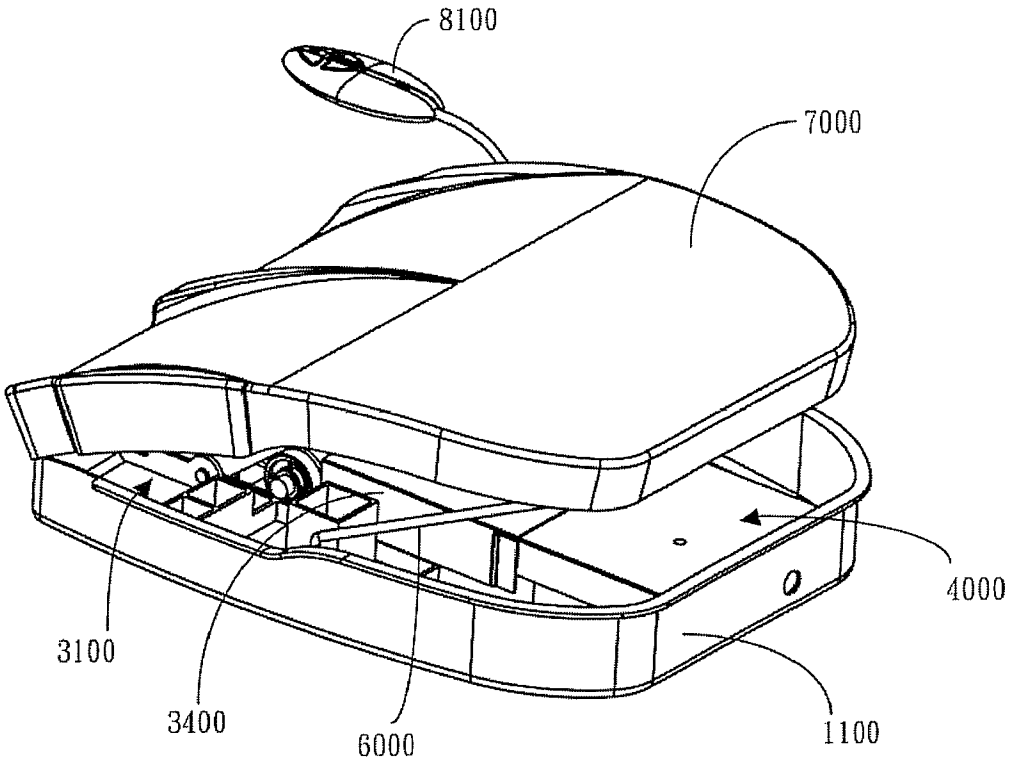
FIG. 9 is a perspective view, showing a semi-open status of a preferred embodiment of the present invention.
Figure 10:
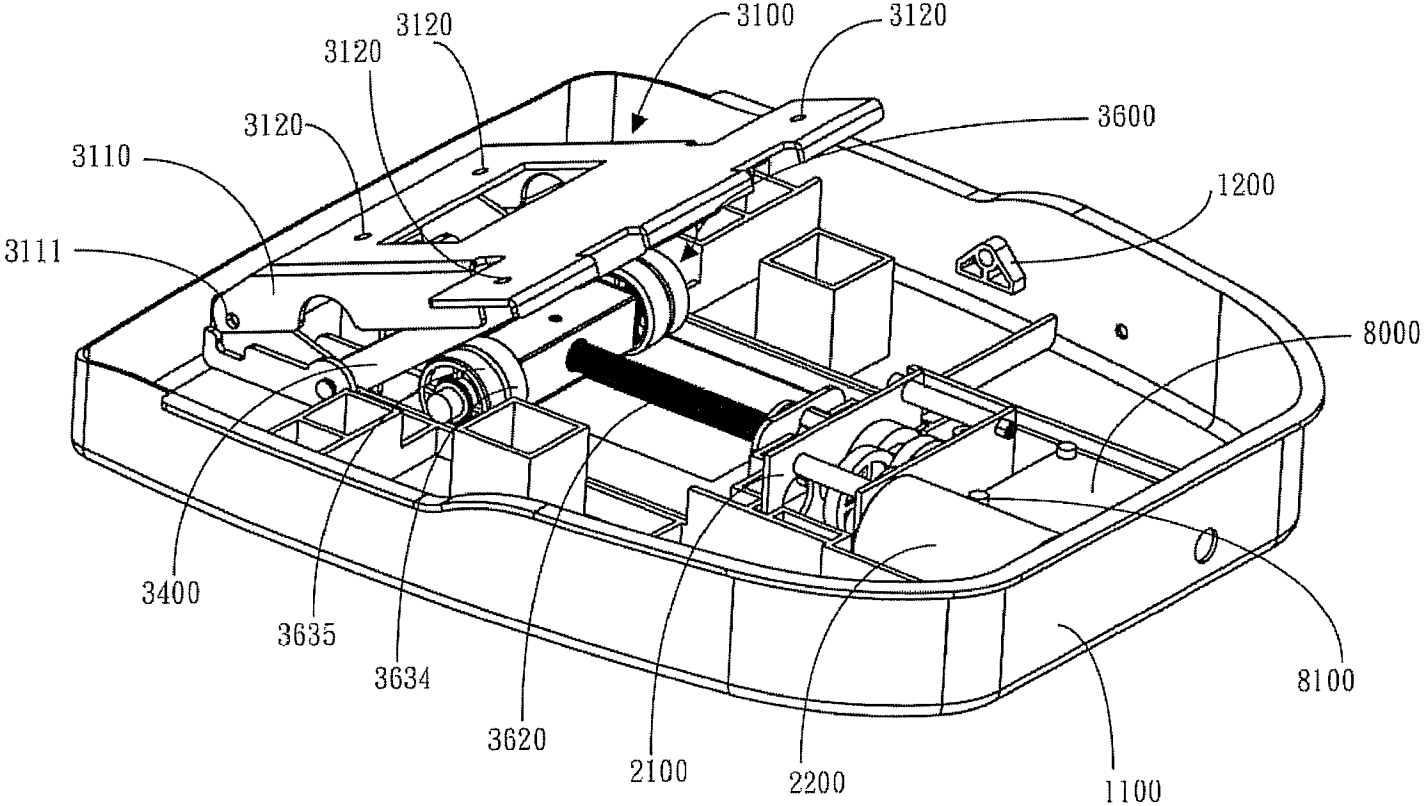
FIG. 10 is a perspective view, showing a semi-open status of a preferred embodiment of the present invention without a seat.
Figure 11:
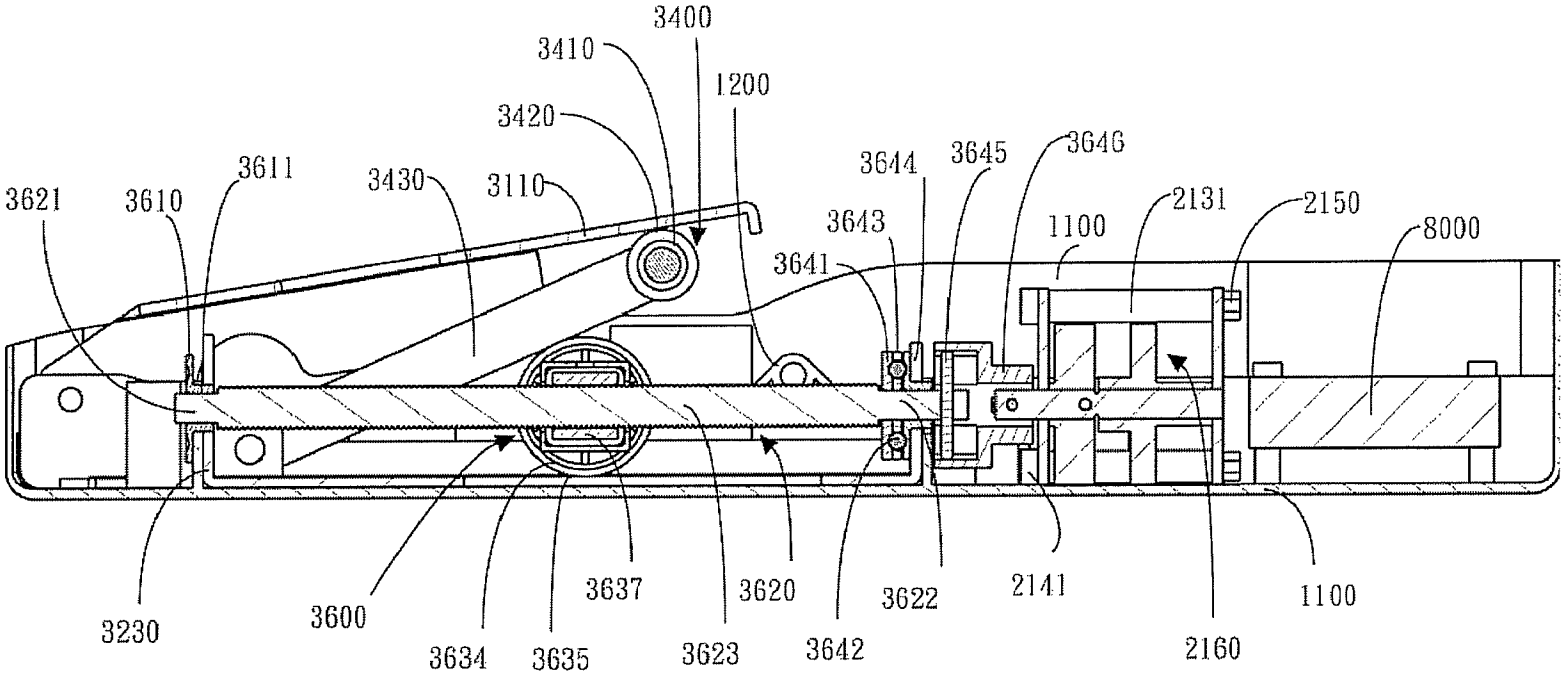
FIG. 11 is a cross-sectional view, showing a semi-open status of a preferred embodiment of the present invention without a seat.
Figure 12:
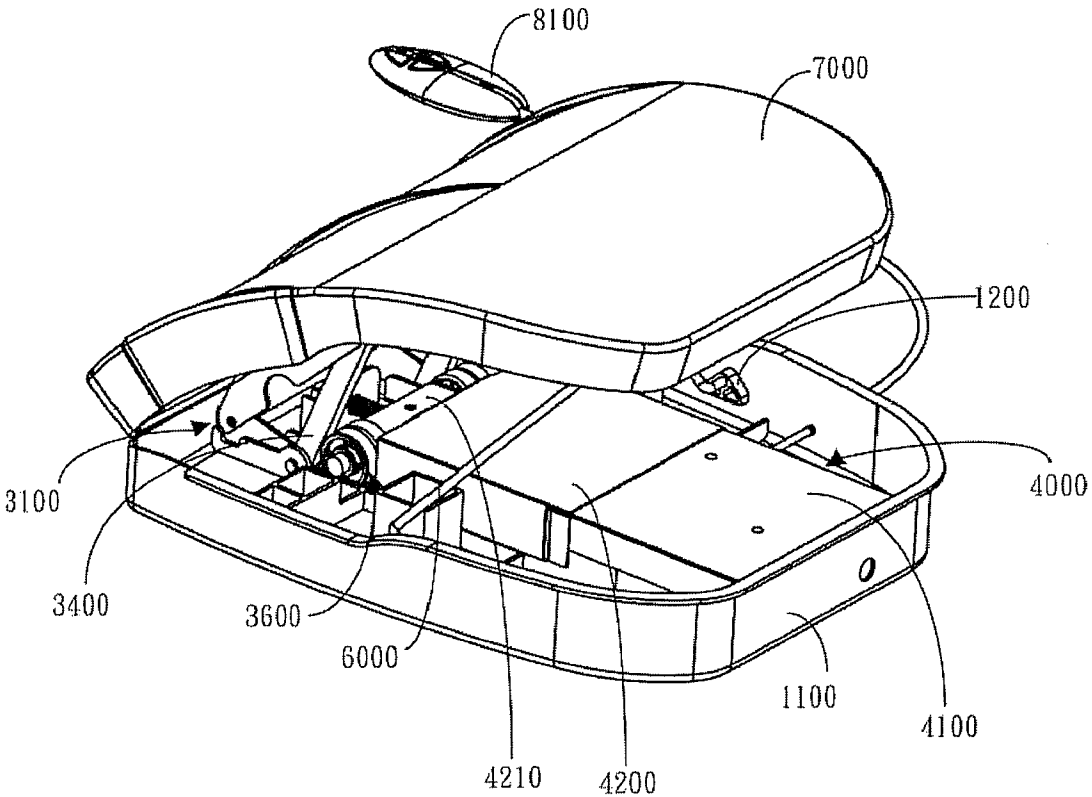
FIG. 12 is a perspective view, showing an open status of a preferred embodiment of the present invention.
Figure 13:
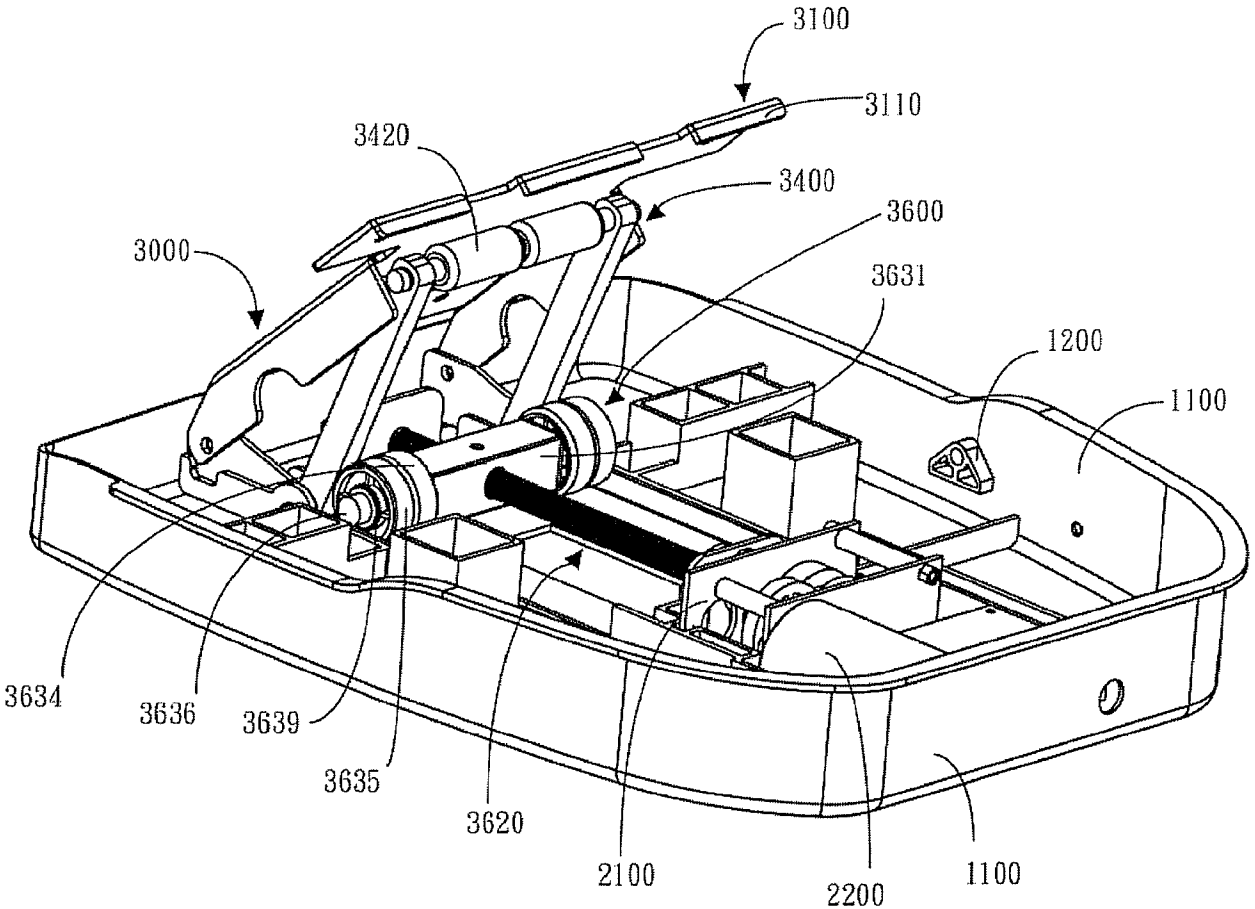
FIG. 13 is a perspective view, showing an open status of a preferred embodiment of the present invention without a seat.
Figure 14:
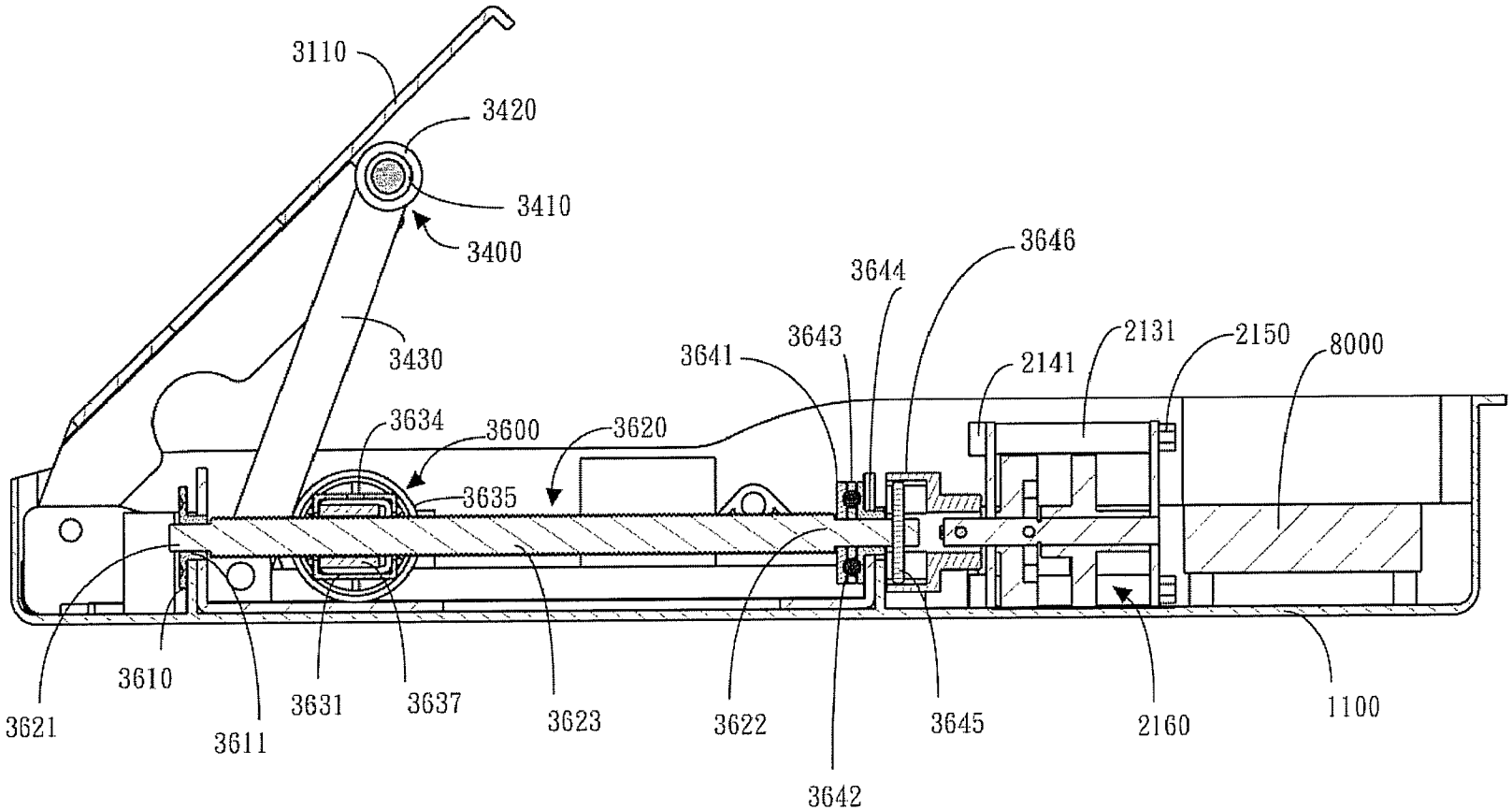
FIG. 14 is a cross-sectional view, showing an open status of a preferred embodiment of the present invention without a seat.

In FIG. 8, the protective cover (4000) is covered onto the locating recess (1400) and the positioning nest (1300) of the base (1000), and the protective cover (4000) includes a fixing cover (4100) and a slide cover (4200). The fixing cover (4100) is covered and secured onto the locating recess (1400) and the positioning nest (1300), and the slide cover (4200) is movably sheathed and installed on the fixing cover (4100), and the slide cover (4200) includes a fixing plate (4210) extending forwardly from the slide cover (4200). The fixing plate (4210) combines with the junction of the sleeve (3631) by combining means, such that the slide cover (4200) can move with the sleeve (3631) of the displacement module (3630).

Figure 1:
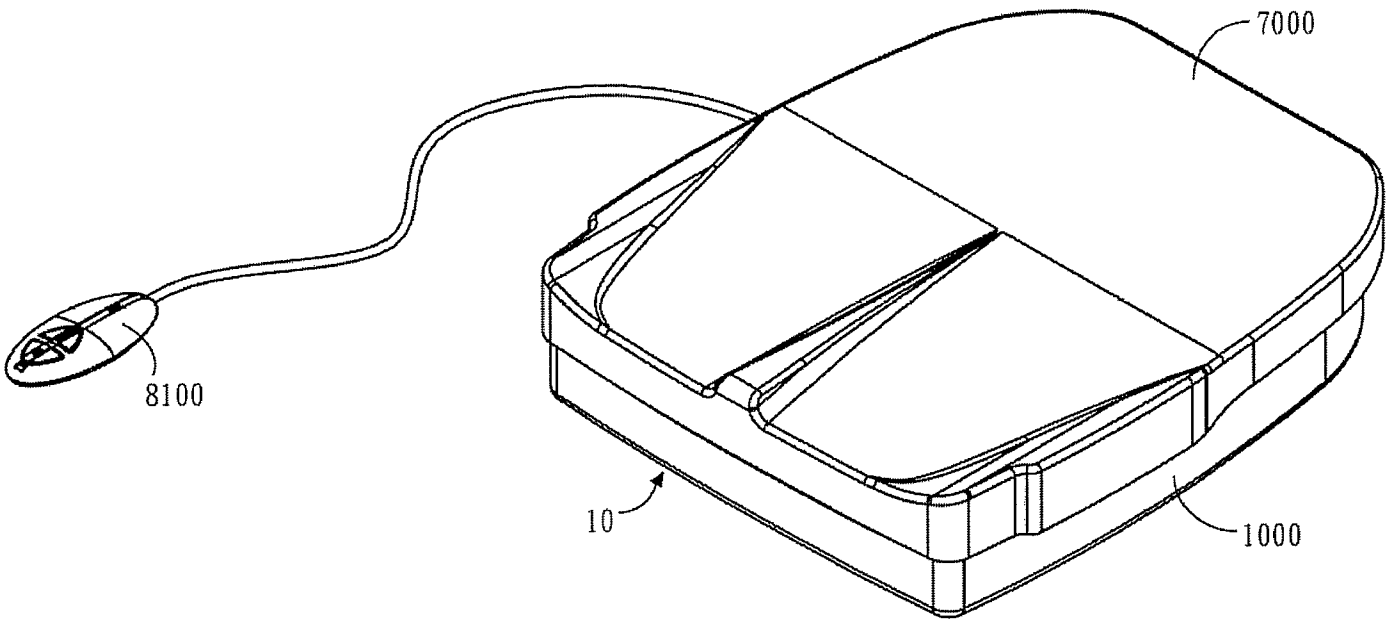
FIG. 1 is a front-side perspective view, showing a closed status of a preferred embodiment of the present invention.
Figure 2:
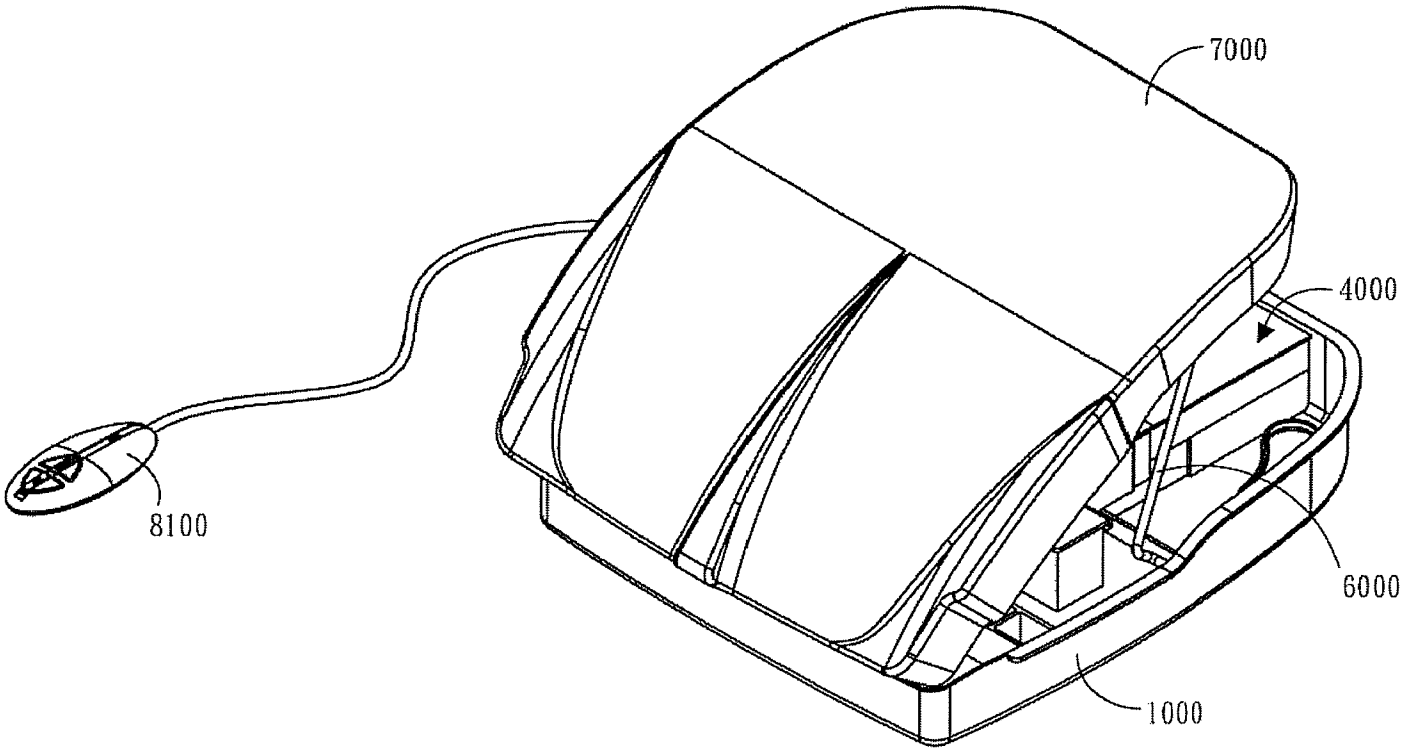
FIG. 2 is a front-side perspective view, showing an open status of a preferred embodiment of the present invention.
Figure 3:
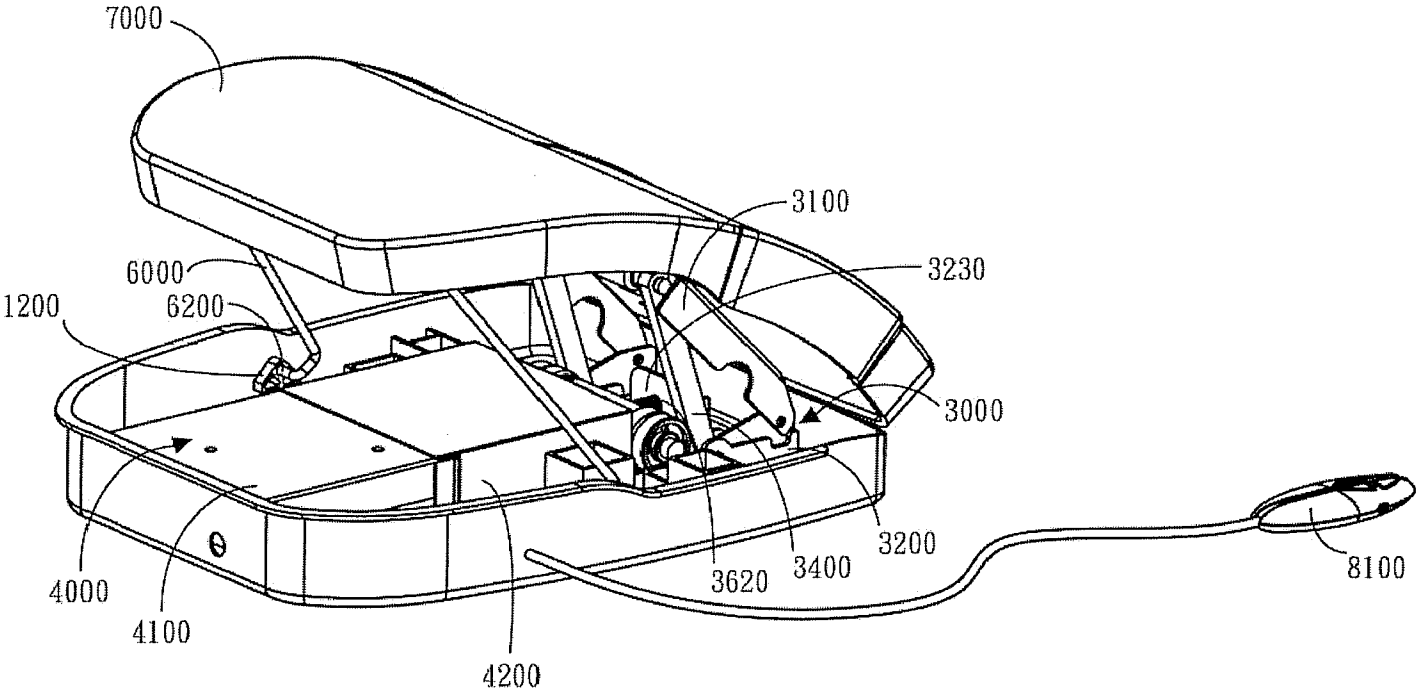
FIG. 3 is a left-rear perspective view, showing an open status of a preferred embodiment of the present invention.
Figure 4:
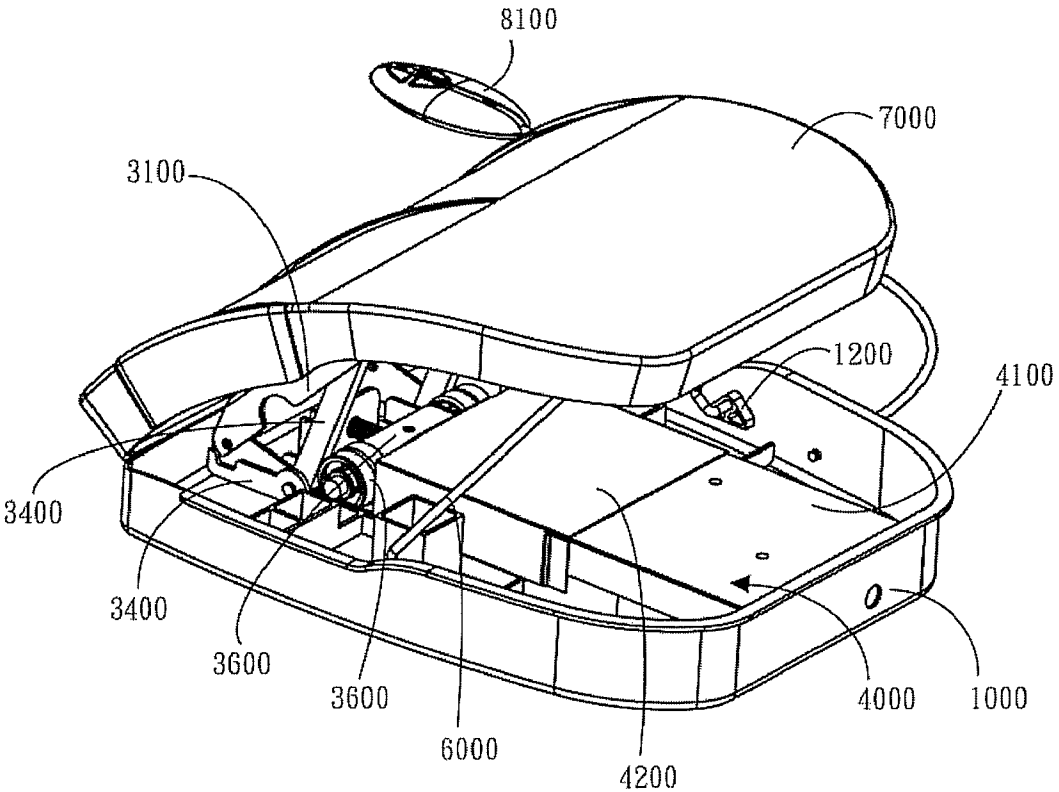
FIG. 4 is a left-rear perspective view, showing an open status of a preferred embodiment of the present invention.
Figure 5:
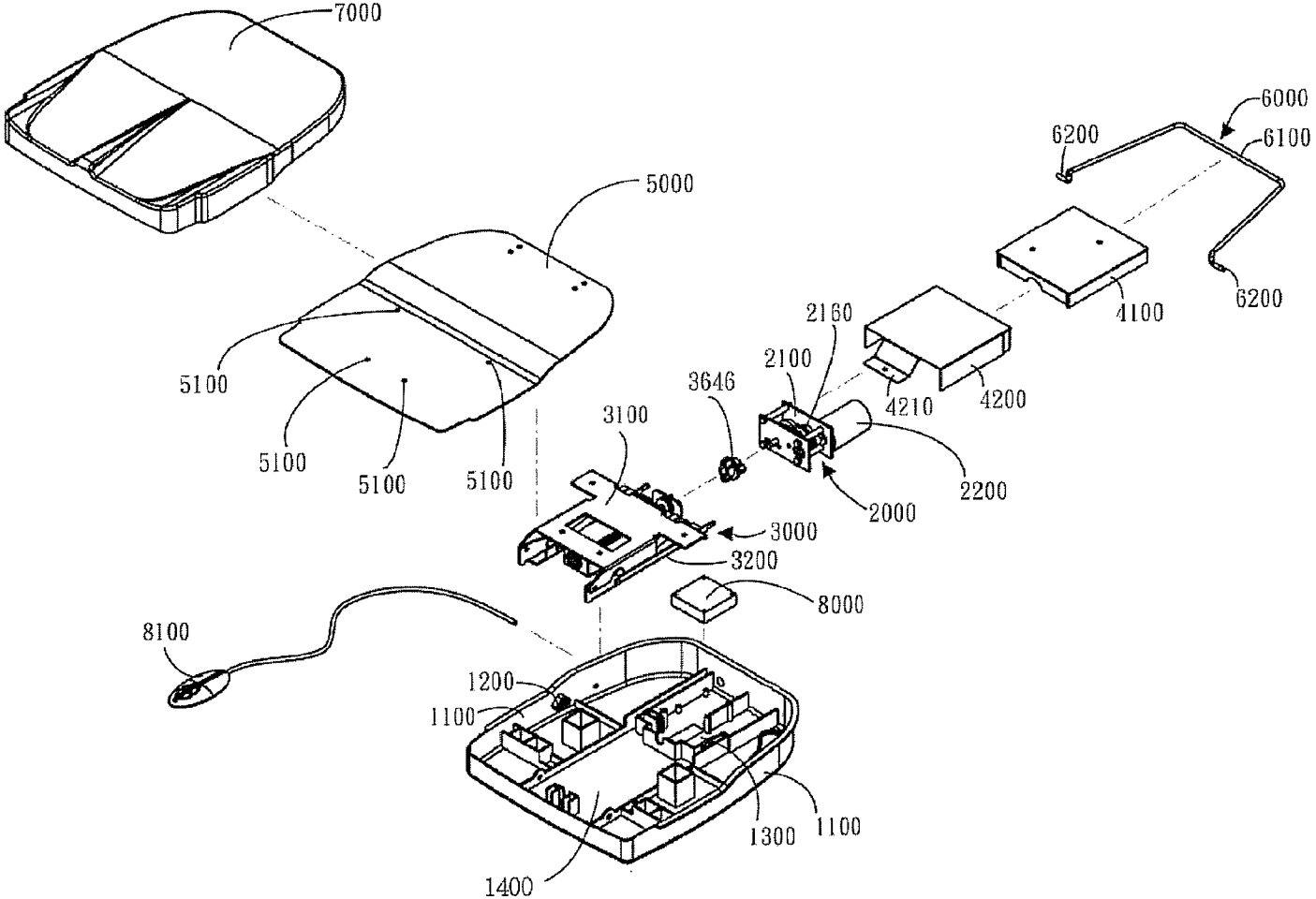
FIG. 5 is an exploded view of a preferred embodiment of the present invention.

In FIG. 5, the seat (5000) is installed onto the top plate (3100) of the shearing device (3000) and includes four combining holes (5100) formed on the seat (5000) and corresponsive to the connecting holes (3120) of the top plate (3100) of the shearing device (3000) respectively for screwing and mounting the seat (5000) onto the top plate (3100) of the shearing device (3000).

The connecting stand (6000) is pivotally coupled between the base (1000) and the seat (5000), and the connecting stand (6000) includes a pivot section (6100) and two pivot ends (6200). The pivot section (6100) is pivotally secured onto a bottom surface of the seat (5000), and the pivot ends (6200) are respectively and pivotally installed into the pivot slots (1200) of the side board (1100) of the base (1000) respectively to limit the inclination of the seat (5000).

The cushion (7000) is secured and mounted onto a top end of the seat (5000) and provided for a user to sit thereon comfortably.

The control device (8000) is coupled to the electric motor (2200) of the driving module (2000) for controlling a rotating direction of the motor shaft (2210) of the electric motor (2200) and controlling a moving direction of the translational device (3600), such that the seat (5000) produces different inclinations, and the control device (8000) includes an input unit (8100) coupled to the control device (8000) and provided for a user to input an instruction.

Figure 15:
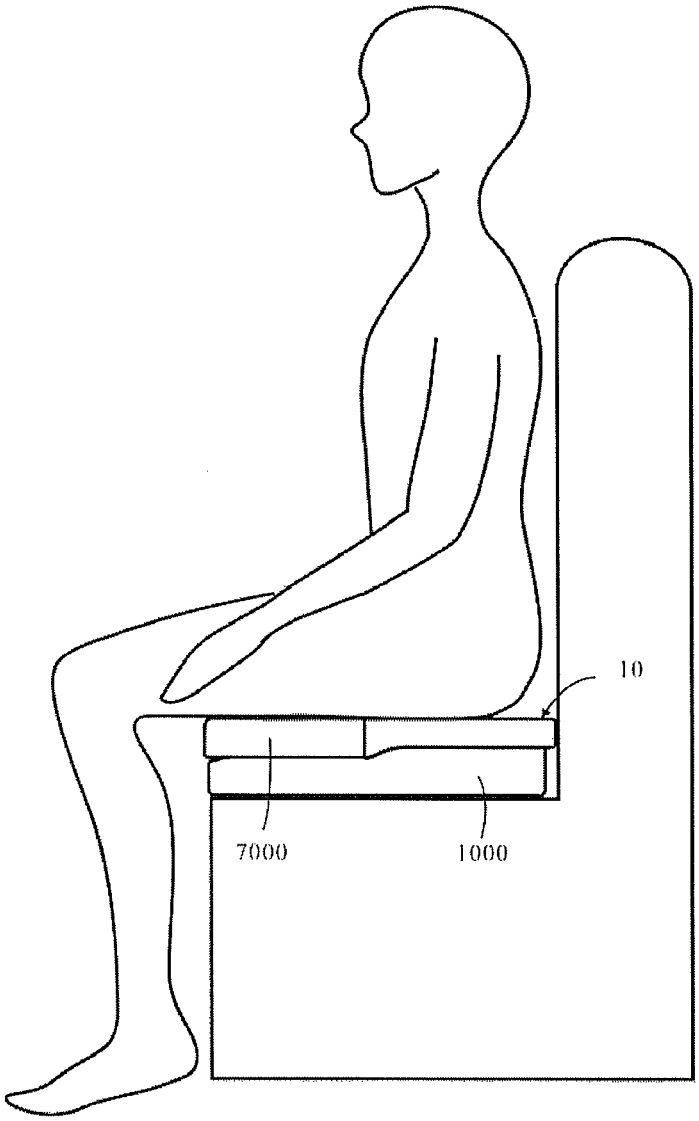
FIG. 15 is a schematic view, showing a closed status of a preferred embodiment of the present invention when an assistant standing seat is in use.
Figure 16:
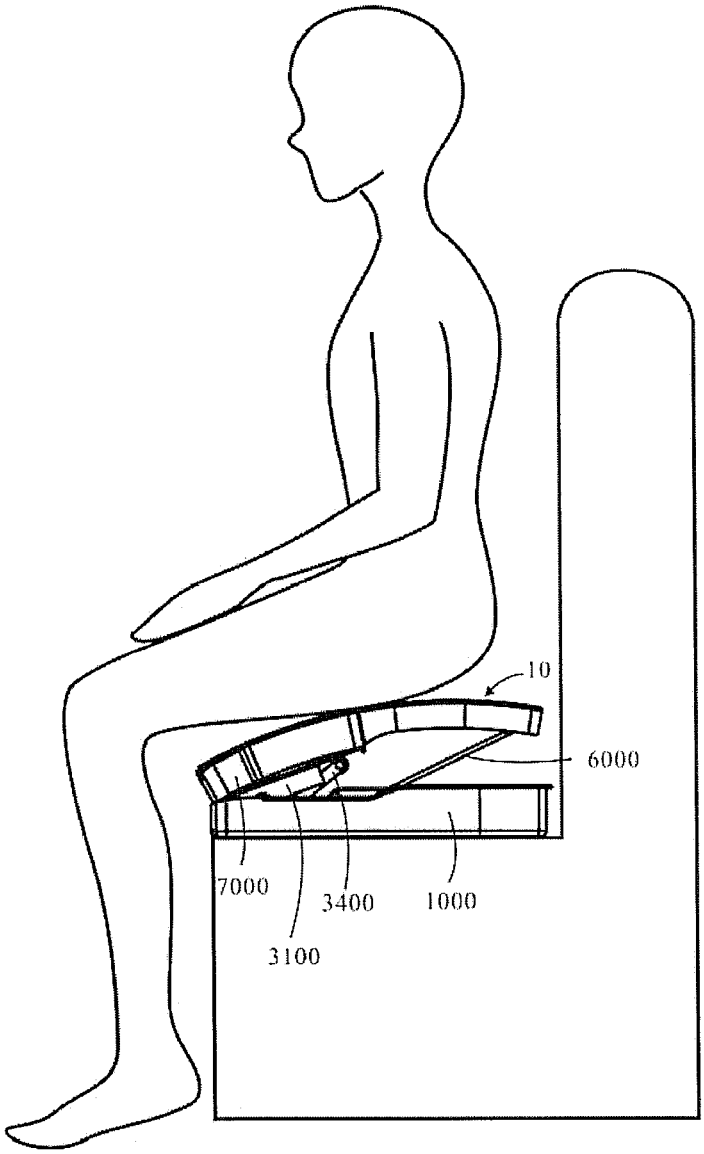
FIG. 16 is a schematic view, showing a semi-open status of a preferred embodiment of the present invention when an assistant standing seat is in use.
Figure 17:
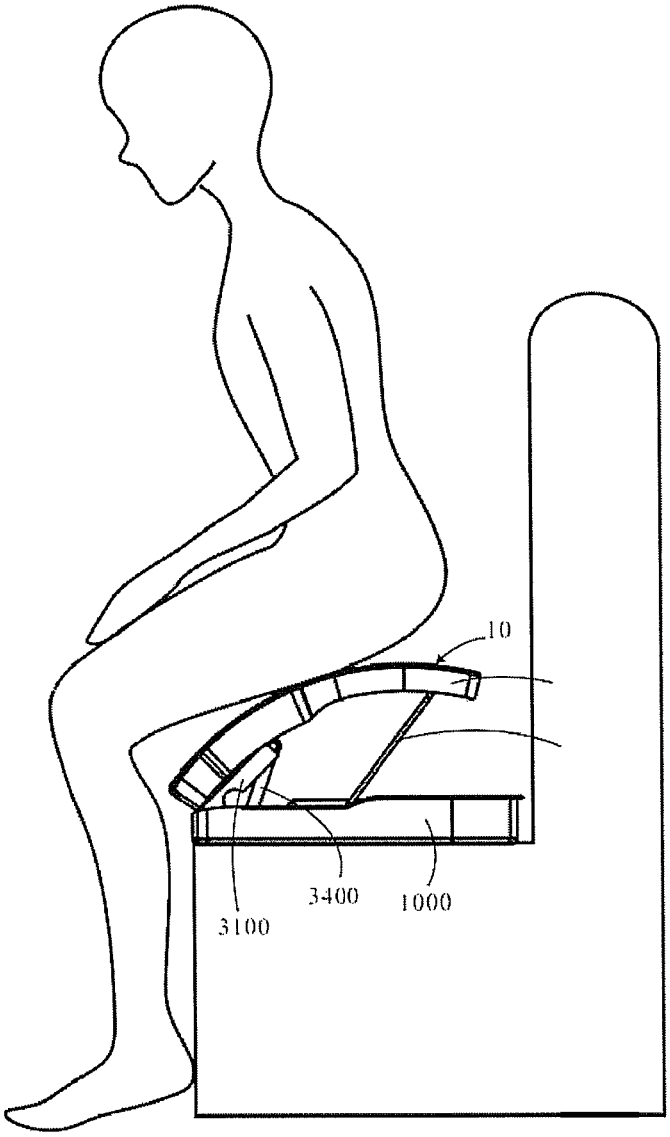
FIG. 17 is a schematic view, showing a fully-open status of a preferred embodiment of the present invention when an assistant standing seat is in use.

In FIGS. 9 to 14, if the user changes the posture from a sitting posture to a standing posture, the user has to move the user's lower leg in a direction towards the user's body as shown in FIG. 15. If the user's lower leg is moved inwardly to a position of the center of gravity of the user's body as shown in FIG. 16, the user can input an elevation instruction through the input unit (8100), so that the control device (8000) drives the motor shaft (2210) of the electric motor (2200) to produce a rotating force. The rotating force is transmitted to the lead screw rod (3620) by the gear module (2100) and the connecting element (3646) to move the displacement module (3630) forward, and pivotally turn the U-shape bracket (3400) to contact with the bottom surface of the seat (5000) to elevate and tilt the seat (5000) gradually. Now, the user simply needs to lean forward slightly to shift the center of gravity of the user's body outward in a direction towards the user's lower leg in order to stand up easily as shown in FIG. 17. Now, since the top plate (3100) and the U-shape bracket (3400) of the shearing device (3000) of the assistant standing seat (10) carry the user's weight simultaneously, therefore the resistance for the translational device (3600) to move horizontally from the rear of the bottom plate (3200) to the front of the bottom plate (3200) can be reduced to prevent a difficult elevation of the assistant standing seat (10).

If the user wants to sit down from a standing posture, the user simply needs to situate the buttock onto the rear of the cushion (7000) and moves the body backward to set the center of gravity of the body onto the seat (5000), and then the user can input a descend instruction from the input unit (8100) to the control device (8000), so that the control device (8000) drives the motor shaft (2210) of the electric motor (2200) to produce an opposite rotating force of the motor shaft (2210). The opposite rotating force is transmitted to the lead screw rod (3620) by the gear module (2100) and the connecting element (3646) to move the displacement module (3630) backward, and pivotally turn the U-shape bracket (3400) to move upward gradually. The seat (5000) will descend to a level position gradually to let the user sit stably.

While the invention has been described by means of specific embodiments, numerous modifications and variations could be made thereto by those skilled in the art without departing from the scope and spirit of the invention set forth in the claims.

What is claimed is:

1. An assistant standing seat, comprising:

a base, having a positioning nest and a locating recess interconnected to the positioning nest;

a driving module, installed in the positioning nest of the base, and having an electric motor used for providing a force source;

a shearing device, installed in the locating recess of the base, and having a top plate, a bottom plate pivotally secured at a front portion of the top plate, a U-shape bracket pivotally secured at a middle portion of the bottom plate, a translational device displaceable between the bottom plate and the U-shape bracket; and a seat, installed at the top plate of the shearing device of the base.

2. The assistant standing seat of claim 1, wherein the shearing device further includes two first shafts and two shaft modules;

the top plate further includes two upper side boards formed on both sides of the top plate respectively and perpendicular to the top plate, each upper side board has a first pivot hole, and the first pivot hole is formed at a front part of the upper side board;

the bottom plate is pivotally mounted to a front part of the top plate and has two first lower side boards, two second lower side boards, a front side board and a rear side board; the first lower side board is formed on both sides of the bottom plate respectively and perpendicular to the bottom plate, each first lower side board has a second pivot hole and a third pivot hole, the second pivot hole is formed at a front part of the first lower side board and matched with the first pivot hole of the upper side board of the top plate, and the third pivot hole is formed at a middle part of the first lower side board; the second lower side boards are formed separately on the bottom plate and corresponsive to each of the first lower side boards, each second lower side board has a fourth pivot hole, each fourth pivot hole is formed on the second lower side board and matched with the third pivot hole of the first lower side board; the front side board is formed at a front end of the bottom plate and perpendicular to the bottom plate, and the front side board has a first penetrating hole; and the rear side board is formed at a rear end of the bottom plate and perpendicular to the bottom plate, and the rear side board has a second penetrating hole corresponding to the first penetrating hole of the front side board;

two first shafts are passed and installed respectively into the first pivot hole of the two upper side boards of the top plate and the second pivot hole of the first lower side board of the bottom plate to pivotally couple the top plate and the bottom plate with each other;

the U-shape bracket further includes a support rod and two support arms;

the support arms are respectively and pivotally secured to both ends of the support rod, each support arm has a pivotal connecting hole formed on a side of the support arm and corresponsive to the third pivot hole of the first lower side board of the bottom plate and the fourth pivot hole of the second lower side board;

the shaft modules are respectively and pivotally secured between the U-shape bracket and the bottom plate, and each shaft module has a second shaft and two position limit rings;

each second shaft is passed and installed between the third pivot hole of the first lower side board of the bottom plate and the fourth pivot hole of the second lower side board to pivotally couple the U-shape bracket to the bottom plate; and the two position limit rings are sheathed and installed between the first lower side board and the second shaft and between the second lower side board and the second shaft.

3. The assistant standing seat of claim 2, wherein the U-shape bracket further includes two rotating sleeves and the rotating sleeves are respectively and pivotally secured to both sides of the support rod for reducing a friction between the support rod and a bottom surface of the top plate.

4. The assistant standing seat of claim 3, wherein the translational device includes a positioning bolt, a lead screw rod, a displacement module and a buffer module; the positioning bolt is sheathed and installed into the first penetrating hole of the front side board of the bottom plate, and the positioning bolt includes a position limit shaft ring; and the position limit shaft ring is formed on a side of the positioning bolt for limiting the position of the lead screw rod;

the lead screw rod is passed and installed into the first penetrating hole of the front side board of the bottom plate and the second penetrating hole of the rear side board of the bottom plate, the lead screw rod has a position limit end, a connecting end and a thread section, the position limit end is passed and installed into the first penetrating hole of the front side board of the bottom plate and sheathed on the position limit shaft ring of the of positioning bolt, the connecting end is passed and installed into the second penetrating hole of the rear side board of the bottom plate, a positioning hole is radially formed at the connecting end, and the thread section is formed on a radial surface of the lead screw rod for moving the displacement module;

the displacement module is transversally passed and installed to the lead screw rod, the displacement module has a hollow sleeve, a displacement element, two socket shafts, two friction rollers and two shaft bolts;

the displacement element is sheathed and installed in the sleeve and has a screw hole, the screw hole is transversally formed on the sleeve and has a diameter matched with the diameter of the thread section of the lead screw rod, such that the sleeve is pivotally turned by the lead screw rod to produce a forward or backward displacement of the sleeve;

the socket shafts are sheathed and installed on both ends of the sleeve respectively, and each socket shaft has a sleeve bearing;

the friction rollers are respectively and pivotally installed to the sleeve bearing of the socket shaft and proximate to the socket shaft, and each friction roller has a diameter;

the shaft bolts are sheathed and installed respectively at an end of the sleeve bearing of the socket shaft to limit the friction roller on the sleeve bearing; and the buffer module is sheathed and installed between the lead screw rod and the rear side board of the bottom plate.

5. The assistant standing seat of claim 4, wherein the buffer module includes a positioning board, a plurality of balls, a fixing board, a ball seat, a second positioning rod and a connecting element;

the positioning board is passed and installed at the connecting end of the lead screw rod, and includes a plurality of ball slots formed on a side of the positioning board;

the balls are corresponsive to the ball slots of the positioning board respectively, for dispersing a force exerted on the lead screw rod;

the fixing board is passed and installed at the connecting end of the lead screw rod and proximate to the positioning board, and includes a plurality of position limit holes formed on the fixing board and corresponsive to the ball slots of the positioning board respectively for limiting a movement range of each ball;

the ball seat is passed and installed at the connecting end of the lead screw rod and proximate to the fixing board for receiving a force transmitted from the lead screw rod;

the second positioning rod is inserted into the second positioning hole of the connecting end of the lead screw rod for limiting the positioning board, the fixing board and the ball seat at the connecting end of the lead screw rod;

the connecting element is installed between the connecting end of the lead screw rod and the motor shaft of the electric motor for fixing the first positioning rod and the second positioning rod, such that the force is transmitted to the lead screw rod, and limiting the rotating direction of the lead screw rod.

6. The assistant standing seat of claim 5, wherein the top plate of the shearing device has four connecting holes, each connecting hole is formed on the top plate, the seat installed on the top plate of the shearing device has four combining holes, and the combining hole is corresponsive to the connecting hole of the top plate of the shearing device for screwing and mounting the seat onto the top plate of shearing device.

7. The assistant standing seat of claim 6, further comprising a cushion secured to a top end of the seat.

8. The assistant standing seat of claim 7, wherein the base has two side boards and two pivot slots, the two pivot slots are formed on the two side boards respectively, and the two pivot slots are corresponsive to each other; the assistant standing seat further comprises a connecting stand; the connecting stand is pivotally coupled between the base and the seat, the connecting stand includes a pivot section and two pivot ends, the pivot section is pivotally secured onto a bottom surface of the seat, and the pivot end is pivotally installed into the pivot slot of the side board of the base.

9. The assistant standing seat of claim 8, wherein the driving module further includes a gear module, and the gear module includes a first partition, a second partition, two socket sets, two bolt sets, two nuts, a shifting gear set, a transmission shaft, an output shaft and a first positioning rod;

the first partition includes two first bolt holes, two third bolt holes, a first fixing hole and a third fixing hole, the first fixing hole is formed on the first partition and proximate to a central position of the first partition, and the third fixing hole is formed on the first partition and proximate to the first fixing hole of the first partition;

the second partition includes two second bolt holes, two fourth bolt holes, a second fixing hole, a fourth fixing hole and a through hole, the two second bolt holes are formed on the second partition and corresponsive to the two first bolt holes of the first partition respectively, the two fourth bolt holes are formed on the second partition and corresponsive to the two third bolt holes of the first partition respectively, the second fixing hole is formed on the second partition and corresponsive to the first fixing hole of the first partition, the fourth fixing hole is formed on the second partition and corresponsive to the third fixing hole of the first partition, the through hole is formed on the second partition and proximate to the third fixing hole and the two fourth bolt holes of the second partition;

each socket set has two sockets; each bolt set has two bolts; the two bolts of one of the bolt set are respectively passed into the first bolt holes of the first partition, the two sockets of one of the socket set, two nuts and the second bolt holes of the second partition; the two bolts of the other bolt set are passed into the third bolt holes of the first partition, the two sockets of the other socket set and the electric motor respectively;

the shifting gear set includes a first transmission gear, a second transmission gear, a third transmission gear, and a fourth transmission gear, and the first transmission gear, the second transmission gear, the third transmission gear and the fourth transmission gear have a first shaft hole, a second shaft hole, a third shaft hole and a fourth shaft hole respectively;

the transmission shaft is passed through the first shaft hole of the first transmission gear and the third shaft hole of the third transmission gear, and pivotally installed between the first fixing hole of the first partition and the second fixing hole of the second partition;

the output shaft is passed into the second shaft hole of the second transmission gear and the fourth shaft hole of the fourth transmission gear and pivotally installed between the third fixing hole of the first partition and the fourth fixing hole of the second partition, the fourth transmission gear is secured onto the output shaft by a bolt rod, and a first positioning hole is axially formed at an end of the output shaft; and the first positioning rod is inserted into the first positioning hole of the output shaft of the gear module.

10. The assistant standing seat of claim 9, wherein the electric motor is mounted in the locating recess of the base and includes a motor shaft and a driving gear, the motor shaft is passed into the through hole of the second partition, and the driving gear is sheathed on the motor shaft of the electric motor and engaged with the first transmission gear of the gear module.

11. The assistant standing seat of claim 10, further comprising a protective cover, wherein the protective cover is covered onto the locating recess and the positioning nest of the base, the protective cover includes a fixing cover and a slide cover, the fixing cover is securely covered onto the locating recess and the positioning nest, the slide cover is movably installed on the fixing cover, and the slide cover has a fixing plate extending forwardly from the slide cover;

the sleeve of the displacement module further includes a junction, such that the sleeve is coupled to the fixing plate of the slide cover by combining means, and the slide cover is movable with the displacement module.

12. The assistant standing seat of claim 11, wherein the displacement module further includes two support rollers and two circular rings, and the support rollers are respectively and pivotally installed at the sleeve bearing of the socket shaft and proximate to the friction roller, and each support roller has a diameter smaller than the diameter of the friction roller, and the circular rings are pivotally and respectively installed between the support roller and the shaft bolt.

13. The assistant standing seat of claim 12, further comprising a control device coupled to the electric motor of the driving module, and the control device having an input unit coupled to the control device.

* * * * *